US005658227A

United States Patent [19]

Stearns

[11] Patent Number: 5,658,227

[45] Date of Patent: Aug. 19, 1997

[54] EXERCISE DEVICE

[75] Inventor: Kenneth W. Stearns, Houston, Tex.

[73] Assignee: Stearns Technologies, Inc., Houston, Tex.

[21] Appl. No.: 526,892

[22] Filed: Sep. 12, 1995

[51] Int. Cl.[6] ..... A63B 21/00

[52] U.S. Cl. ..... 482/96; 482/95; 482/57; 482/72

[58] Field of Search ..... 482/95, 148, 96, 482/57, 51, 72, 106, 110, 111; 472/106, 110

[56] References Cited

U.S. PATENT DOCUMENTS

| | | | |
|---|---|---|---|
| D. 218,624 | 9/1970 | Margolles . | |
| 1,952,548 | 3/1934 | Hayes | 472/108 |
| 2,107,447 | 2/1938 | Marlowe . | |
| 2,145,940 | 2/1939 | Marlowe . | |
| 2,470,544 | 5/1949 | Bell . | |
| 2,642,288 | 6/1953 | Bell . | |
| 2,825,563 | 3/1958 | Lawton . | |
| 2,924,456 | 2/1960 | Miller . | |
| 3,134,378 | 5/1964 | Harwood . | |
| 3,380,737 | 4/1968 | Elia . | |
| 3,446,503 | 5/1969 | Lawton . | |
| 4,248,420 | 2/1981 | Hayes . | |
| 4,257,590 | 3/1981 | Sullivan . | |
| 4,300,760 | 11/1981 | Bobroff . | |
| 4,336,934 | 6/1982 | Hannagan . | |
| 4,353,547 | 10/1982 | Jenkinson . | |
| 4,452,448 | 6/1984 | Ausherman . | |
| 4,542,899 | 9/1985 | Hendricks . | |
| 4,586,706 | 5/1986 | Chen . | |
| 4,603,855 | 8/1986 | Sebelle . | |
| 4,616,825 | 10/1986 | Anderson . | |
| 4,629,185 | 12/1986 | Amann . | |
| 4,641,833 | 2/1987 | Trethewey | 487/72 |
| 4,645,200 | 2/1987 | Hix . | |
| 4,657,244 | 4/1987 | Ross . | |
| 4,721,303 | 1/1988 | Fitzpatrick . | |

(List continued on next page.)

FOREIGN PATENT DOCUMENTS 2619017 2/1989 France .

OTHER PUBLICATIONS

Exercycle Corporation, Exercycle Brand Exercisers, Symphony, All Body Action, CSA, E-Force Cross-Trainer, Model T1200 1994.

Roadmaster Corporation 1995, DP Specialty Fit For Life, Iron Horse Club Series Item #R-8030T.

Roadmaster Corporation 1995, DP Specialty Fit For Life, Iron Horse Pro Series Item #R-8027 T.

Roadmaster Corporation 1995, DP Specialty Fit For Life, Iron Horse Gravity Body Lift, Item #R-8023 T.

American Sports, Cardio-Rider.

Weslo, Inc. 1994, Cardioglide—The Ultimate Fat Burning Machine Aeroflex, Aeroflex Complete Fitness System.

*Primary Examiner*—Jerome Donnelly

*Attorney, Agent, or Firm*—Bush, Riddle & Jackson, L. L. P.

[57] ABSTRACT

An exercise device (10) has a handlebar (30) with handgrips (32) for gripping by a user (U). An adjustment plate member (26) is mounted for pivotal movement about a pivot (28) on a fixed support plate member (18). A seat (58) supports the weight of the user U to resist to the rotation of the adjustment plate (26). A generally horizontal exercise movement is performed by pulling on the handlebar (30) and simultaneously pushing on foot pedals (70) on a foot frame (68) secured to the adjustment plate member (26). The horizontal exercise movement shown in FIGS. 1 and 2 can be easily converted to a vertical exercise movement shown in FIG. 3 at the discretion of the user (U) by changing the motion exerted against the handlebar (30) by the user (U). An adjustment lever (100) may be adjusted along adjustment plate (26) to vary the force exerted by the weight of the user (U) on seat (58) against adjustment plate member (26) through a force applying link (63), pivot (112), inner adjustment levers (110), and shaft (106) carried by the adjustment plate member (26). The adjustment lever (100) also is used to convert the device from pulling type exercises to pushing type exercises and vice versa.

66 Claims, 7 Drawing Sheets

U.S. PATENT DOCUMENTS 4,728,099 3/1988 Pitre .
4,743,010 5/1988 Geraci .
4,798,378 1/1989 Jones .
4,817,943 4/1989 Pipasik .
4,850,587 7/1989 Lin .
4,943,051 7/1990 Haskins .
4,949,951 8/1990 Deola .
4,949,954 8/1990 Hix .
4,986,538 1/1991 Ish, III .
5,072,929 12/1991 Peterson .
5,156,650 10/1992 Bals .
5,178,599 1/1993 Scott .
5,512,027 4/1996 Chen .
5,527,249 6/1996 Harris ..... 482/96

10A
30
32
34
40
36
U
118
DC
106
24
100
112
26
37
121
18
28
72
58
63
68
60
114
114
66
70'
70

EXERCISE DEVICE

BACKGROUND OF THE INVENTION

1. Field of the Invention

This invention relates to an exercise device. In particular it relates to an exercise device of the type permitting the user to selectively perform multiple exercise movements. Still more particularly, the invention relates to an exercise device which (1) simulates a horizontal pulling or rowing type exercise or alternatively a horizontal pushing or pressing forward type exercise; (2) simulates a vertical pull down type exercise or alternatively a vertical pressing upward type exercise and (3) allows motions intermediate horizontal or vertical type directions, either in a pressing mode or a pulling mode.

2. Description of the Prior Art

Heretofore, exercise devices or machines have been provided in which a user sits on a seat while pushing foot pedals and pulling on handgrip members at the same time. Examples of such devices are shown in U.S. Pat. Nos. 2,642,288 to J. D. Bell, 2,924,456 to H. J. Miller, and 4,300,760 to Bobroff. Resistance to the exercise movement of pushing against leg actuated foot pedals and/or pulling on arm actuated handlebars is provided by the weight of the user on the seat. The seat with the user thereon is raised by the user pulling on the arm actuated means and pushing on the leg actuated means simultaneously in an exercise movement. Weight of the user resists upward movement of the seat. These patents permit only a single rowing type exercise movement in a horizontal direction, but they do not provide a mechanism for a horizontal pressing forward type exercise movement or vertical pull down or pressing up type exercise movement at the discretion of the user. Also, no adjustment means is provided to vary the force exerted by the weight of the user against the leg actuated foot pedals and the arm actuated handlebars.

A machine sold under the trademark Cardioglide shows a similar type horizontal pulling exercise device in which the force resistance means is a hydraulic cylinder that restricts the movement of the seat. The hydraulic resistance is adjustable by rotation of a knob, which, in turn, adjusts to the size of a fluid orifice in the cylinder.

A machine sold under the trademark CSA E-Force has an alternative handlebar position in which a user can perform an upper body horizontal pushing action, but the user must remove and then reinsert the handlebar in the alternative position. The device allows only horizontal movement and has no resistance adjustment.

Several exercise gym machines allow upper body movement in multiple directions. Examples of such machines are U.S. Pat. Nos. 4,542,899 to Hendricks, 4,629,185 to Amann, 4,728,099 to Pitre, 4,949,951 to Deola, 4,986,538 to Ish, and 4,353,547 to Jenkenson. Such multi-direction exercise machines are either very complex and expensive or are very limited in their motions. Also, none provide any means for allowing coordinated movements of the upper body with the lower body.

There is a need for an exercise machine that allows a wide variety of movements yet is simple and inexpensive to produce and further provides other features described as follows.

Identification of Objects of the Invention

In view of the limitations of the prior art machines;

A primary object of the invention is to provide an exercise machine that allows a wide variety of exercise movements, yet is simple and inexpensive to produce.

Another object of the invention is to provide a machine as above that takes up very little floor space.

Another object of the invention is to provide a machine as above for allowing coordinated movement of a variety of upper body movements with simultaneous lower body exercise.

Another object of the invention is to provide a machine as above in which resistance to the various exercise movements is derived at least in part from the bodyweight of the user.

Another object of the invention is to provide a machine as above in which the resistance to exercise may be easily selectively varied.

Another object of the invention is to provide a machine as above in which the machine may easily be converted from a pull type machine to a press type machine.

Yet another object of the invention is to provide a machine in which alternative horizontal only or vertical only exercise movements are allowed with selection of such movements by the user merely by changing the direction of force of upper limbs while exercising.

Still another object of the invention is to provide a machine as above in which upper body exercise may be at any direction from horizontal to vertical with selection of such movements by the user merely by changing the direction of force of upper limbs while exercising.

SUMMARY OF THE INVENTION

The objects identified above, as well as other features are realized in the invention of an exercise device in which a user seated on a seat may grip a handlebar and selectively perform a generally vertical pull down type exercise movement or a generally horizontal rowing or pulling exercise movement while seated on the seat. The same handlebar is utilized for both exercise movements. The exercise movements may be changed by the user by changing the force exerted by the arms of the user against the handlebar without any additional adjustments being required. A linkage for the handlebar is pivotally connected between a support frame and an adjustment plate which is pivotally connected to the support frame. The device may be converted to a machine for press up vertical movements or push out horizontal exercise movements.

A seat is provided on a seat frame which is pivotally connected to the support frame. A link is pivotally connected between the seat frame and an adjustment plate for transferring a force proportional to the weight of the user on the seat against the adjustment plate tending to rotate the plate in a direction to provide resistance to the exercise movements of the handlebar. Foot pedals are linked to the adjustment plate such that the adjustment plate tends to rotate about its pivot point with respect to the frame when the user pushes forward on the pedals.

A rearward pulling exercise movement against the handlebar (or a downward pulling exercise movement) by the user is normally performed at the same time as a forward pushing exercise movement against the foot pedals by the feet of the seated user. The handlebar linkage transfers arm force to the adjustment plate tending to rotate it with respect to the frame when the handlebars are pulled horizontally, as in a rowing type exercise, in the same direction of rotation caused by forward pushing of the foot pedals. The weight of the user on the seat, acting through an adjustably pivoted link to the adjustment plate, tends to rotate the adjustment plate in an opposite direction to that caused by the pulling handlebar movement and pushing foot pedal movement. Consequently, the user's weight provides resistance to the exercise movements. The seat is raised and lowered as a consequence of the exercise movements.

An adjustment lever carried by the adjustment plate may be manually adjusted in a series of positions on the adjustment plate for varying the resistance force applied by the weight of the user on the seat. A seat connecting link between the seat frame and the adjustment plate is coupled to the adjustment lever about a movable pivot point. Such pivot point is moved upon manual adjustment of the lever to change the point of application of force from the seat to the adjustment plate. The lever may also be adjusted so that the application of force from the seat connecting link reverses the direction of rotation of the adjustment plate caused by the user's weight, thereby converting the machine to a push up or press type exercise machine (and a horizontal push out machine), where the resistance of the user's weight opposes a pushing movement of the handlebar. Thus, a resistance force may be applied selectively against either a pulling exercise movement of the handlebar or a pushing exercise movement of the handlebar by manual adjustment of the adjustment lever.

When the adjustment lever is moved to a position which reverses the direction of rotation of the adjustment plate caused by the user's weight, vertical exercise movements are converted into a press up type of exercise movement of the handlebars. In either case, for vertical press up/horizontal push forward or vertical pull down/horizontal pull back (rowing) movements, the linkage between the handlebars and the adjustment plate allows exercise in a direction between horizontal and vertical. In other words, motions in any direction between horizontal and vertical are possible without any adjustment of the machine. All that is required is that the user change the angle of attack of the force of his arms and hands. By changing the position of the adjustment lever, the machine may be changed from a horizontal pull back/vertical pull down machine to a machine for horizontal push out/vertical press up or any angle between horizontal and vertical by change of user force to change angle of attack.

In order to restrict exercise movement to either a horizontal movement or a vertical movement, cam grooves are provided in a cam plate attached to an arm of the linkage mechanism which connects the handlebars to the adjustment plate. A cam follower carried by the adjustment plate is placed in the cam grooves of the cam plate. The grooves are designed and arranged such that when the cam follower is in a first groove, the linkage causes the handlebars to move between an extreme outward horizontal position and an extreme inward horizontal position. When the cam is in a second groove, the linkage causes the handlebars to move between an extreme upward vertical position and an extreme downward vertical position. The first and second grooves are connected such that the cam can move between the first and second grooves at the extreme inward horizontal position and the extreme downward vertical position. Accordingly, a user may convert the machine from a vertical pull down machine (or press up machine, depending on the position of the adjustment lever) to a pull back rowing machine (or push forward machine, depending on the position of the adjustment lever) by merely causing the handlebars to be pulled back to the extreme inner horizontal position or returned downward to the extreme lower vertical position and then changing the direction of force exerted against the handlebars from horizontal to vertical or vice versa.

An important feature of this invention is in providing an exercise device having a handlebar, which may be selectively moved in a pull back rowing (or push forward) generally horizontal exercise movement, or in a pull down (or press up) general vertical exercise movement by manual gripping of the handlebar. If desired, a horizontal exercise movement may be combined with the vertical exercise movement by alternating horizontal and vertical movements. The only action required to change the exercise movement of the handlebar from a vertical movement to a horizontal movement, or vice versa, is for the user to change the direction of force exerted against the handlebar by the arms of the user.

Another important feature of the invention is a manually operated adjustment lever which may be actuated to apply the resistance of the user's bodyweight selectively against the pushing movement of the handlebar or to convert the machine to resist a pulling movement of the handlebar. Different muscles of the user are employed in a pulling movement as opposed to a pushing movement. Thus, it may be desirable to change the resistance acting against a pulling movement of the handlebar to a resistance acting against a pushing movement of the handlebar, or vice versa. The resistance is provided by the weight of a user seated on a seat applied against an adjustment plate operatively connected to the handlebar. The amount of resistance applied against handlebar movements, either pushing type or pulling type, may be varied by adjustment of the manually operated adjustment lever. The weight of the user on the seat is applied as a proportional force to the adjustment plate by a link coupled between the seat and the adjustment plate. Of course, other add-on resistance means can easily be added to the device.

Another feature of the invention includes foot pedals and an associated foot frame secured to the adjustment plate to allow the feet of the user to push (or to pull) against the foot pedals to assist in overcoming the resistance of the seated user to provide an exercise movement for the lower limbs or legs of the user.

Other advantages and features of the invention will become more apparent by reference to the drawings which are appended hereto and wherein like numerals indicate like elements and wherein an illustrative embodiment of the invention is shown.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE PREFERRED EMBODIMENT OF THE INVENTION

Figure 1:
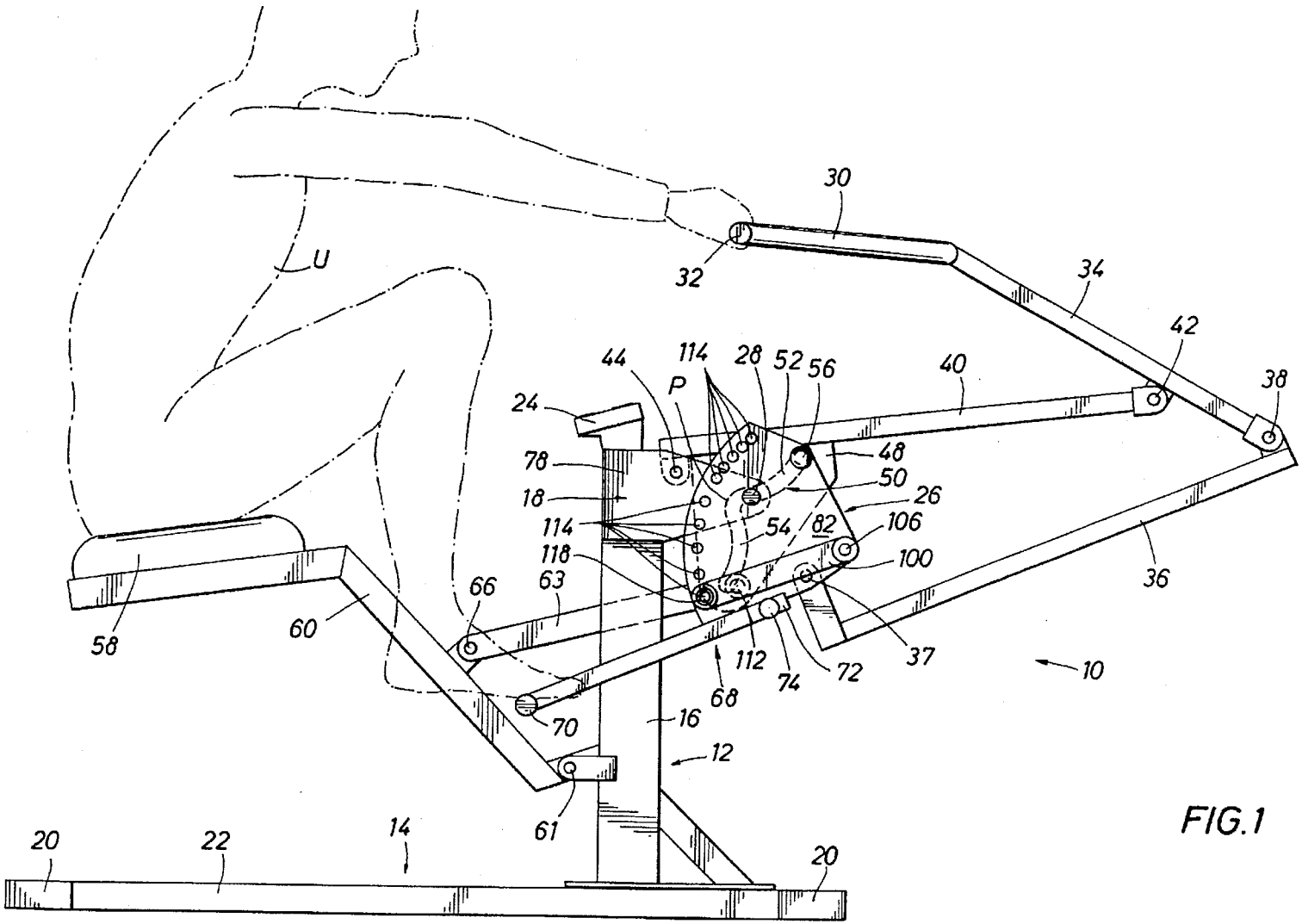
FIG. 1 is a side elevation of a preferred embodiment of the exercise device of this invention where the device includes a cam arrangement which restricts exercise either to horizontal movement or to vertical movement and in which the device is configured for pulling exercises, the illustration showing a user seated on a lowered seat and gripping a handlebar in a front extended or forward reaching position for commencing a generally horizontal rowing type exercise movement by manually pulling back on the handlebar while simultaneously pushing forward on foot pedals, wherein the weight of the user on such seat resists the pulling movement.
Figure 2:
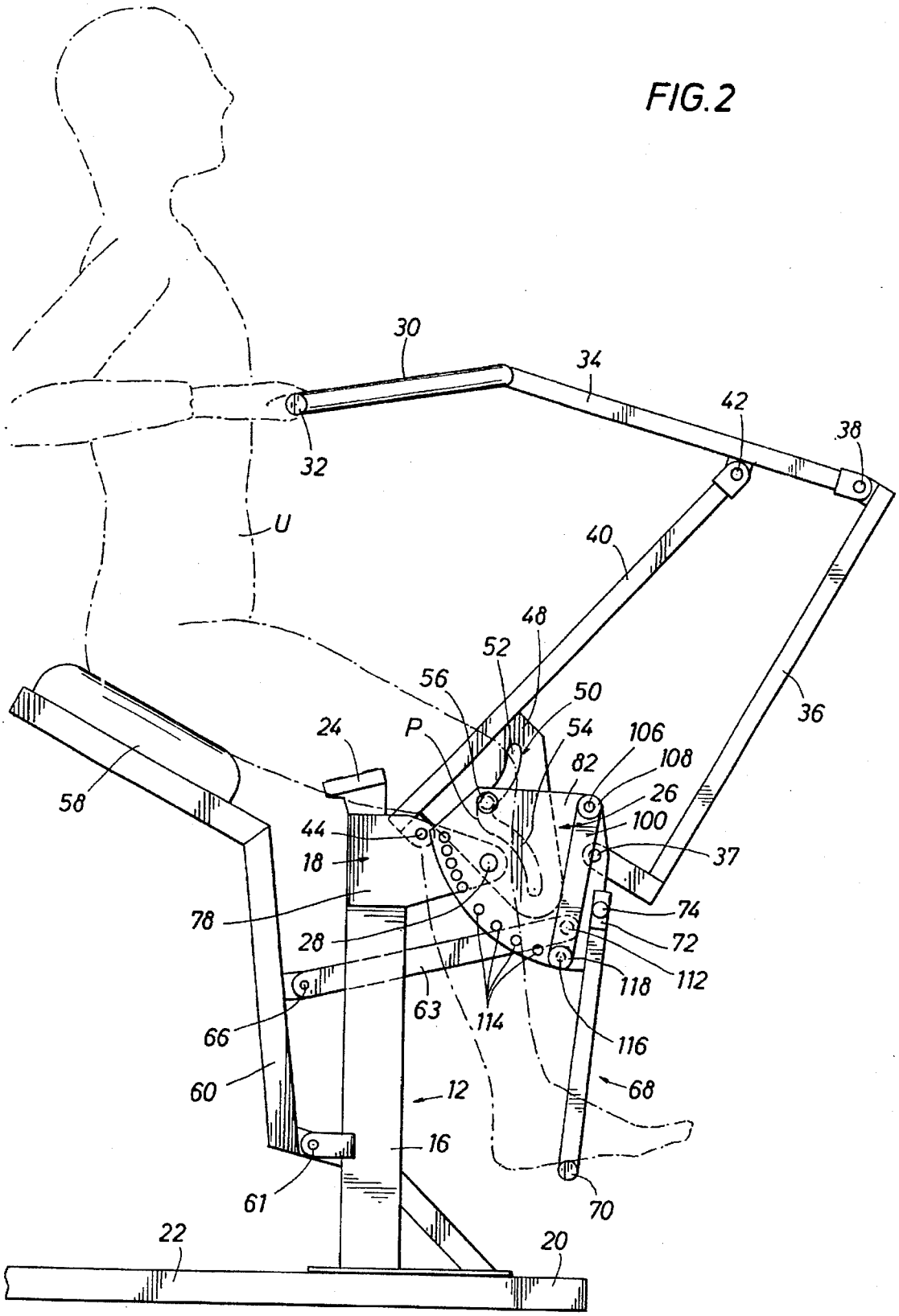
FIG. 2 is a side elevation similar to FIG. 1 but shows the exercise device at the inner end of the generally horizontal exercise movement with the seat shown in a raised position and the handlebar in a rear retracted position with the foot pedals in a forward extended position.
Figure 3:
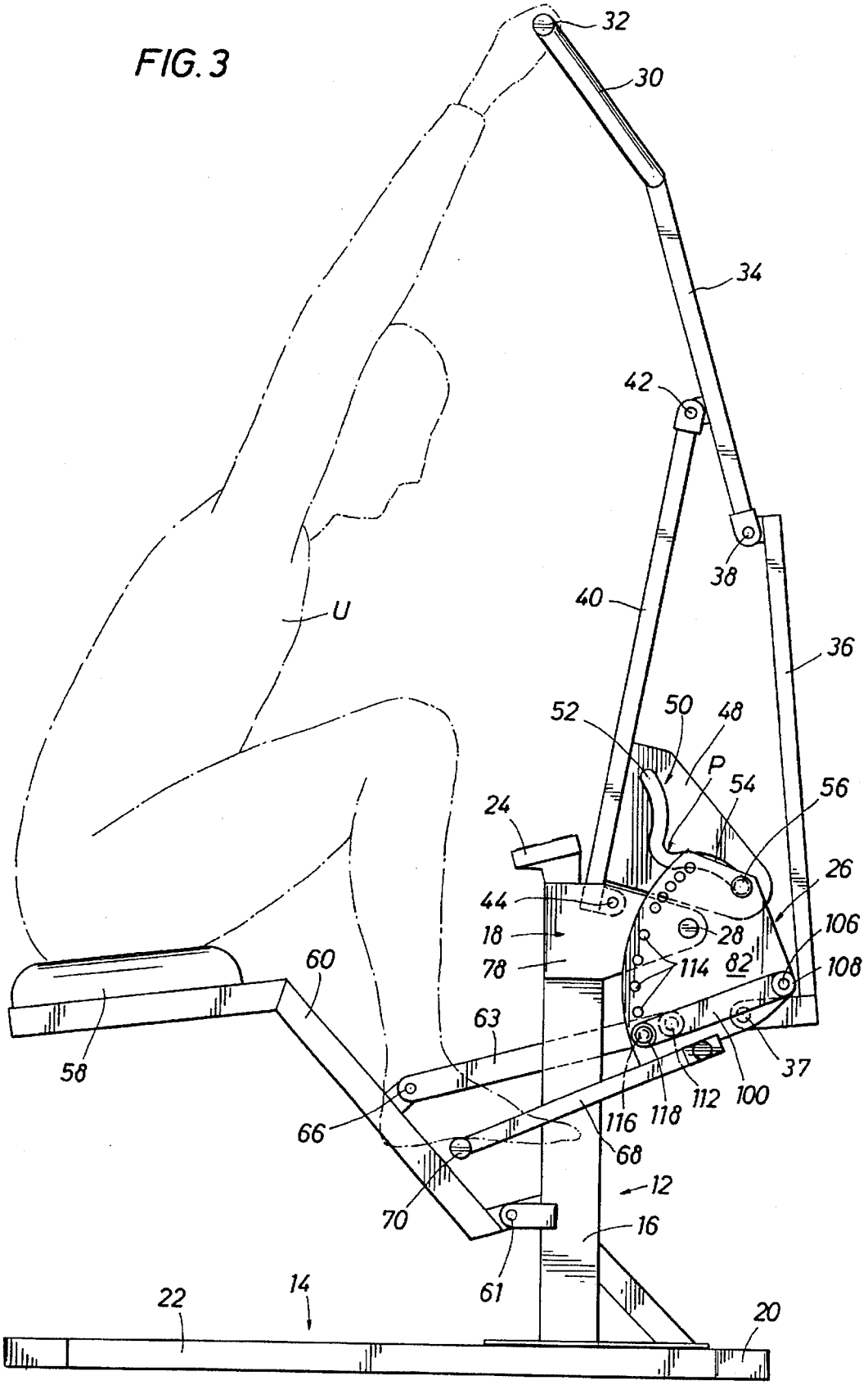
FIG. 3 is a side elevation of the exercise device of FIGS. 1 and 2 after the user has guided the device into vertical pull down mode and the handlebar has moved to its upper extreme position, the illustration showing the commencement of a generally vertical pull down exercise movement in which the seated user is pulling downwardly on the handlebar and pushing forwardly against the foot pedals.

Referring now to the drawings for a better understanding of the invention, and more particularly to FIGS. 1–3, an exercise device of this invention is shown generally at 10 comprising a fixed support frame generally indicated at 12. The fixed support frame 12 includes a base 14 and a vertically extending post 16 having an upper support member 18 secured thereto. Base 14 includes transverse end frame members 20 connected by a horizontal frame member 22.

Figure 5:
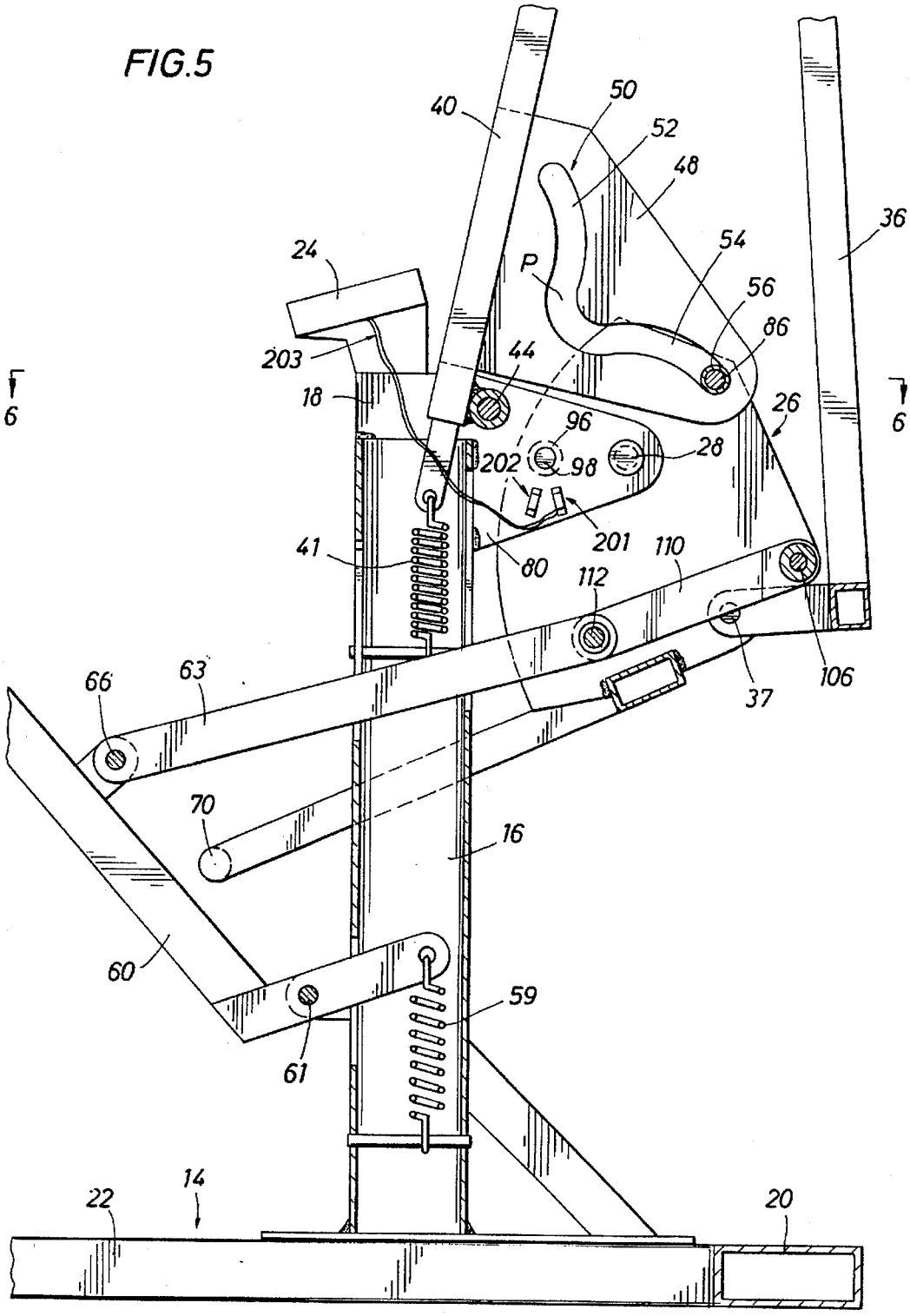
FIG. 5 is an enlarged side elevation of a portion of the exercise device of FIG. 3 with certain parts broken away for illustration.

An adjustment plate member generally indicated at 26 is pivotally mounted about a fixed pivot 28 on upper support member 18. A handlebar 30 includes handgrips 32 and is carried by a handlebar link 34 which is pivotally connected at one end to an end link 36 about pivot 38. The other end of end link 36 is pivotally connected at 37 to adjustment plate member 26. An intermediate link 40 has an upper outer end pivotally mounted at 42 to handlebar link 34 intermediate the length of link 34 and has a lower inner end pivotally mounted at 44 to fixed support member 18. An optional counterbalance spring 41 is connected to the lower end 44 of link 40 as shown in FIG. 5.

A cam plate 48 is fixed to intermediate link 40 by welding or other means known in the art. It has a cam slot 50 which includes a pair of communicating slot portions 52 and 54 which extend in different directions. Slot portions 52, 54 join each other at an intersection point P of slot portions 52, 54 of slot 50. A cam follower 56 secured to adjustment plate member 26 is mounted within the cam slot 50 for guiding the pivotal movement of intermediate link 40 and handlebar 30 relative to the frame 12.

The cam slot portion 52 is designed and arranged in coordination with the design of link members 34, 40 and 36 such that when cam follower is in slot portion 52, the handgrips 32 of handlebar 30 move in a substantially horizontal direction. FIGS. 1 and 2 illustrate such horizontal movement. The cam portion 54 is designed and arranged in coordination with the design of link members 34, 40 and 36 such that when cam follower is in slot portion 54, the handgrips 32 of handlebar 30 move in a substantially vertical direction. FIG. 3 illustrates vertical movement between the upper most vertical position of handgrips 32 dictated by cam follower 56 in slot portion 54. FIG. 2 shows the cam follower 56 approaching the point P of the intersection of slot portions 52 and 54 which corresponds with the lowermost position of handgrips 32 which is the same point, that is the transition point, as the inner most position of handgrips of horizontal motion. In other words, the user U can repetitively perform a generally horizontal, back and forth exercise by maintaining the cam follower 56 in the slot portion 52, and the user U can repetitively perform a generally vertical, up and down exercise by maintaining the cam follower 56 in the slot portion 54. The user U can move between these two slot portions 52 and 54 simply by driving the cam follower 56 through and beyond the junction P.

The weight of the user U provides resistance to the exercise movements. User U during the exercise movements sits on a seat 58 having a seat frame 60 pivotally mounted at 61 to post 16. A counterbalance spring 59 is connected to link 60. (FIG. 5) A seat connecting link 63 extends through a slot in post 16. One end of the link 63 is pivotally mounted at 66 to seat frame 60. The opposed end is operatively connected to adjustment plate 26 for providing an adjustable resistance to the exercise movements as will be explained further hereinafter and as shown particularly in FIG. 6. A foot support frame shown generally at 68 is generally U-shaped and has a pair of lower foot pedals or rests 70 extending from distal ends thereof and away from one another. A transverse frame member 72 of frame 68 is secured to adjustment plate member 26 for movement therewith. Auxiliary foot rests 74 are provided at opposite ends of transverse frame member 72.

FIGS. 1 and 2 illustrate a generally horizontal exercise movement of handlebar 30 in which user U pulls horizontally on handlebar 30 and simultaneously pushes against foot pedals 70 to rotate adjustment plate member 26 in a counterclockwise direction about pivot 28. FIG. 3 illustrates a generally vertical exercise movement of handlebar 30 in which user U pulls downwardly on handlebar 30 and simultaneously pushes outwardly on foot pedals 70 to rotate adjustment plate member 26 in a counterclockwise direction about pivot 28. As a result of the horizontal exercise movement from FIG. 1 to FIG. 2, user U is lifted vertically on seat 58. The weight of user U tends to rotate plate 26 in a clockwise direction. When the user reduces his muscular force on handlebars 32, the weight of the user returns exercise device 10 to the position of FIG. 1.

FIG. 3 illustrates the commencement of the generally vertical exercise movement by user U. Cam follower 56 in slot portion 54 of cam slot 50 controls the movement of intermediate link 40 and handlebar 30. Follower 56 may move past the intersection point P of slot portions 52 and 54. Accordingly, a user U can select a vertical exercise movement, or a horizontal exercise movement simply by changing the direction of force exerted against handlebar 30. For example, to change or convert from a horizontal movement to a vertical movement, user U pulls rearwardly a maximum amount from the position shown in FIG. 2 so that follower 56 moves into slot portion 54 from slot portion 52 to provide a generally vertical motion for handgrips 32. The weight of the user causes the machine to move to the position of FIG. 3. A pull down force by the arms of the user returns the machine to a downward position similar to that shown in FIG. 2, but with the cam follower 56 just beneath the junction P, as opposed to just above the junction P.

Figure 6:
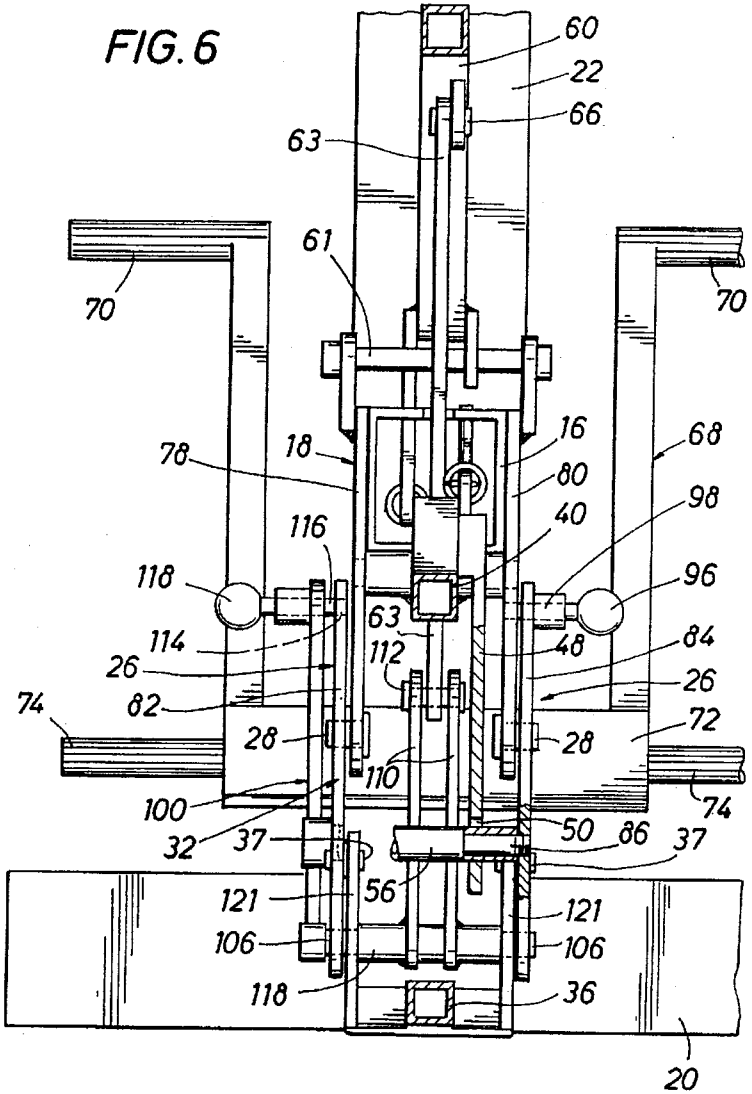
FIG. 6 is a sectioned view taken generally along lines 6—6 of FIG. 5 which shows particularly the linkages for connecting the seat, handlebar, and foot pedals.
Figure 4:
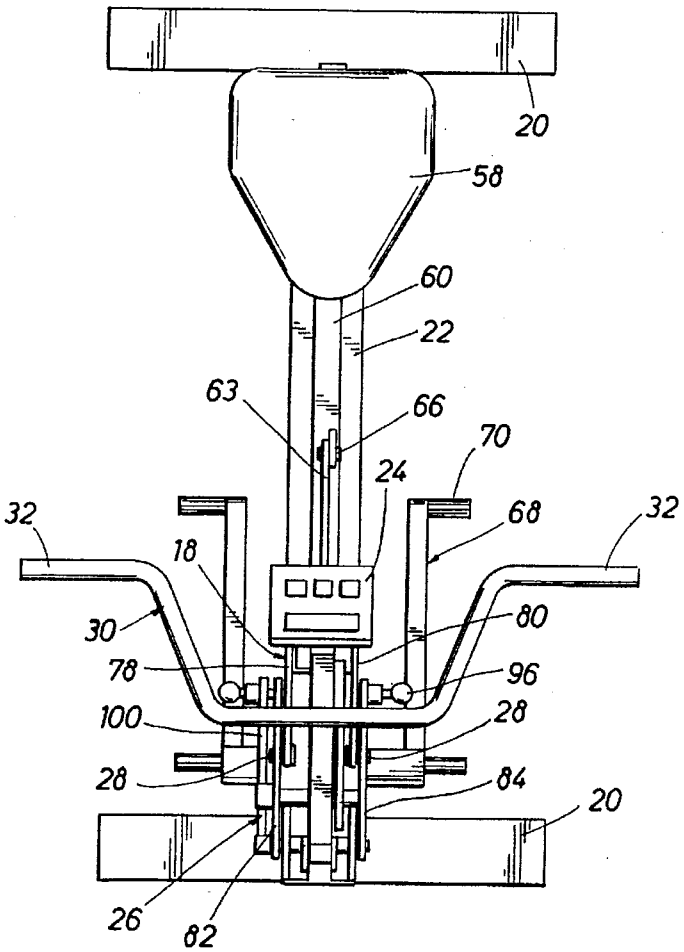
FIG. 4 is a top plan view of the exercise device of FIGS. 1–3, showing the linkages which connect the seat, handlebar, and foot pedals to an adjustment plate member for coordinating the exercise movements and transmitting resistance force.

Referring now particularly to FIG. 6, a downwardly directed, section view of FIG. 5 along lines 6—6 illustrates the functioning of adjustment plate member 26. Upper support plate member 18 includes a pair of parallel supporting plate portions 78 and 80 secured to opposed sides of post 16 as shown in FIG. 4. Adjustment plate member 26 includes a pair of parallel adjustment plates or plate portions 82 and 84 pivotally mounted about fixed pivot 28 on respective fixed supporting plate portions 78 and 80. Adjustment plate portions 82 and 84 are secured to each other by a transverse frame member 72 and a pin 86 disposed within sleeve follower 56, which, in turn, is disposed within slot 50 of cam plate 48. When exercise device 10 is not being used, adjustment plate portion 84 forms a locking plate having a manually actuated retractable pin member 96 received within an opening 98 on fixed plate portion 80 of upper support member 18 to hold or lock adjustment member 26 against any movement. When exercise device is placed in condition for operation, pin member 96 is retracted from opening 98 and held in a retracted position during operation of exercise device 10. A suitable lug (not shown) may be provided to retain pin member 96 in a retracted portion removed from opening 98.

An outer indexing or adjustment lever generally indicated at 100 is fixed at its forward end to a shaft 106 received within openings in adjustment plate portions 82 and 84. A sleeve 118 fixed to shaft 106 extends between plate portions 82 and 84 as shown in FIG. 6 and is free to pivot relative to adjustment plate portions 82 and 84. A pair of parallel inner adjustment levers 110 are fixed to sleeve 118 at one end and are pivotally connected at an opposite end to force applying link 63 about pivot 112. Outer adjustment lever 100 and inner adjustment levers 110 are maintained in transverse alignment with each other at all times because shaft 106 is fixed to outer adjustment lever 100 and also fixed to inner adjustment levers 110 through sleeve 118 which is fixed to shaft 106. Thus, pivot 112 for force applying link 63 is movable with levers 100 and 110 relative to adjustment plate member 26 and remains in transverse alignment with levers 100, 110 at all times.

Outer adjustment lever 100 is manually adjusted relative to force adjustment member 26 for movement of pivot 112 and force applying link 63 to vary the resistance applied against the exercise movements. Adjustment plate portion 82 has a series of openings 114 spaced about an arcuate path. (See FIGS. 1, 2, 3.) A manually retractable pin 116 carried by outer adjustment lever 100 is urged inwardly by a spring. Knob 118 connected to pin 116 may be manually gripped and pulled outwardly for withdrawing pin 116 from one opening 114 for engagement with another selected opening 114. A retaining lug (not shown) for holding pin 116 in a retracted position upon rotation of pin 116 may be provided.

Operation of Exercise Device for Horizontal Exercise Movement

FIGS. 1 and 2 illustrate a generally horizontal exercise movement with user U exerting a pulling force on handlebar 30 and a pushing force against foot pedals 70. A user U sits on seat 58 in the lowered position of seat 58 as shown in FIG. 1. Pin member 96 has previously been withdrawn from opening 98 in order to permit rotation of adjustment plate member 26 about pivot 28. The weight of user U is applied through link 63, inner levers 110 and sleeve 108 against adjustment plate member 26 to tend to rotate adjustment plate member 26 in a clockwise direction (as viewed from the right hand side of the machine and shown FIG. 1) relative to pivot 28 on support plate member 18. Follower 56 is positioned at the upper end of slot portion 52 of cam slot 50 on cam plate 48 which is secured to link 40. Upon pulling handlebar 32 rearwardly and pushing foot pedals 70 forwardly from the position of FIG. 1, adjustment plate member 16 tends to rotate in a counterclockwise direction about pivot 28 until reaching the position shown in FIG. 2.

Rotation of adjustment plate 26 in a counterclockwise direction from the position of FIG. 1 results in the raising of seat 58 and user U seated thereon through sleeve 118, inner levers 110 and force applying link 63. Thus, the weight of user U provides resistance to the horizontal exercise movement. Handlebar 30 is maintained in a generally horizontal direction during the exercise movement by follower 56 in upper cam portion 52 which guides intermediate link 40 in an arc which causes handlebar 30 to move in a generally horizontal direction. To return to the position of FIG. 1 from the position of FIG. 2, the user relaxes the pulling force of his arms exerted against handlebar 30 and his pushing force exerted against foot pedals 70, so that the weight of user U on seat 58 causes the exercise device 10 to return to the position of FIG. 1 in a clockwise movement of adjustment plate member 26 about pivot 28. Cam follower 56, as it nears the end of the pulling action against handlebar 30 as shown in FIG. 2, is positioned adjacent the intersection P of cam slot portions 52 and 54. During the horizontal exercise movement, follower 56 remains in cam portion 52.

As illustrated in FIG. 5 is a console 24 secured to the upper end of port 16. Such console is positioned so that it is visible to user U for visually representing exercise characteristics through use of the device, such as time, repetition ram, and the like. A repetition counting arrangement includes a magnet 201 mounted on the rotating adjustment plate member 26 (by adhesive or other means known in the art), and a Hall effect sensor 202 (or other magnetic sensor) mounted on stationary upper support member 18 (by adhesive or other means known in the art). The arrangement of the magnet 201 and the sensor 202 is such that the magnet 201 passes the sensor 202 each time the handle 30 is moved through either the horizontal path of motion or the vertical path of motion. The sensor 202 generates a measurable pulse each time the magnet 201 passes the sensor 202. The pulse is transmitted to the console 24 by means of a cable 203 interconnected therebetween. Those skilled in the art will recognize that a microprocessor or other electronics in the console 24 may be programmed or arranged to generate various performance characteristics based on the number and frequency of generated pulses.

Operation of Exercise Device for Vertical Exercise Movement

FIGS. 3 and 5 show a generally vertical exercise movement utilizing handlebar 30. To convert from the horizontal exercise movement to the vertical exercise movement, user U pulls handlebar 30 rearwardly a maximum amount from the position of FIG. 2 so that cam follower 56 moves through the intersection P of cam slot portions 52 and 54 into cam slot portion 54. Relaxation of the force exerted on hand grips 32 causes adjustment member 26 to rotate clockwise which causes handlebar 30 to raise to the position of FIG. 3 with cam follower 56 at the end of cam slot portion 54. FIG. 3 shows the position in which the vertical exercise movement is commenced with a downward pulling of handlebar 30 and pushing against foot pedals 70. The movement of adjustment plate member 26 for the vertical exercise movement shown in FIG. 3 is similar to the movement of adjustment plate member 26 for the horizontal exercise movement as shown in FIGS. 1 and 2. The primary difference is that the cam follower 56 is positioned in cam slot portion 54, which is designed and arranged in cooperation with linkages 40 and 34 and 36 to cause handgrips 32 to move in a generally vertical direction. Thus, at the discretion of user U, either a generally horizontal exercise movement or a generally vertical exercise movement may be performed. If desired, the generally vertical exercise movement may be combined with the generally horizontal exercise movement and performed alternatingly by movement of handlebar 30 a maximum amount for movement of follower 56 alternatingly in portions 54 and 52.

Cam plate 48 and follower 56 thus control the movement of handlebar 30 and handgrips 32. Various methods of limiting the travel of follower 56 in cam plate 48 may be provided which would therefore limit the motion of handlebar 30. Other mechanisms for controlling the position of link 40 and thereby controlling the path of handgrips 32 while exercising may be provided. For example, an electronic positioning device that controls the position of link 40 throughout the exercise movement may be substituted for the cam plate 48, cam follower 56 mechanism of FIGS. 1–6. Such device, which can be a servomechanism can cause the path of the handlebar 30 to move in at least two arcuate sections of varying radii, or an arcuate section and a linear section or in a closed loop.

Figure 7:
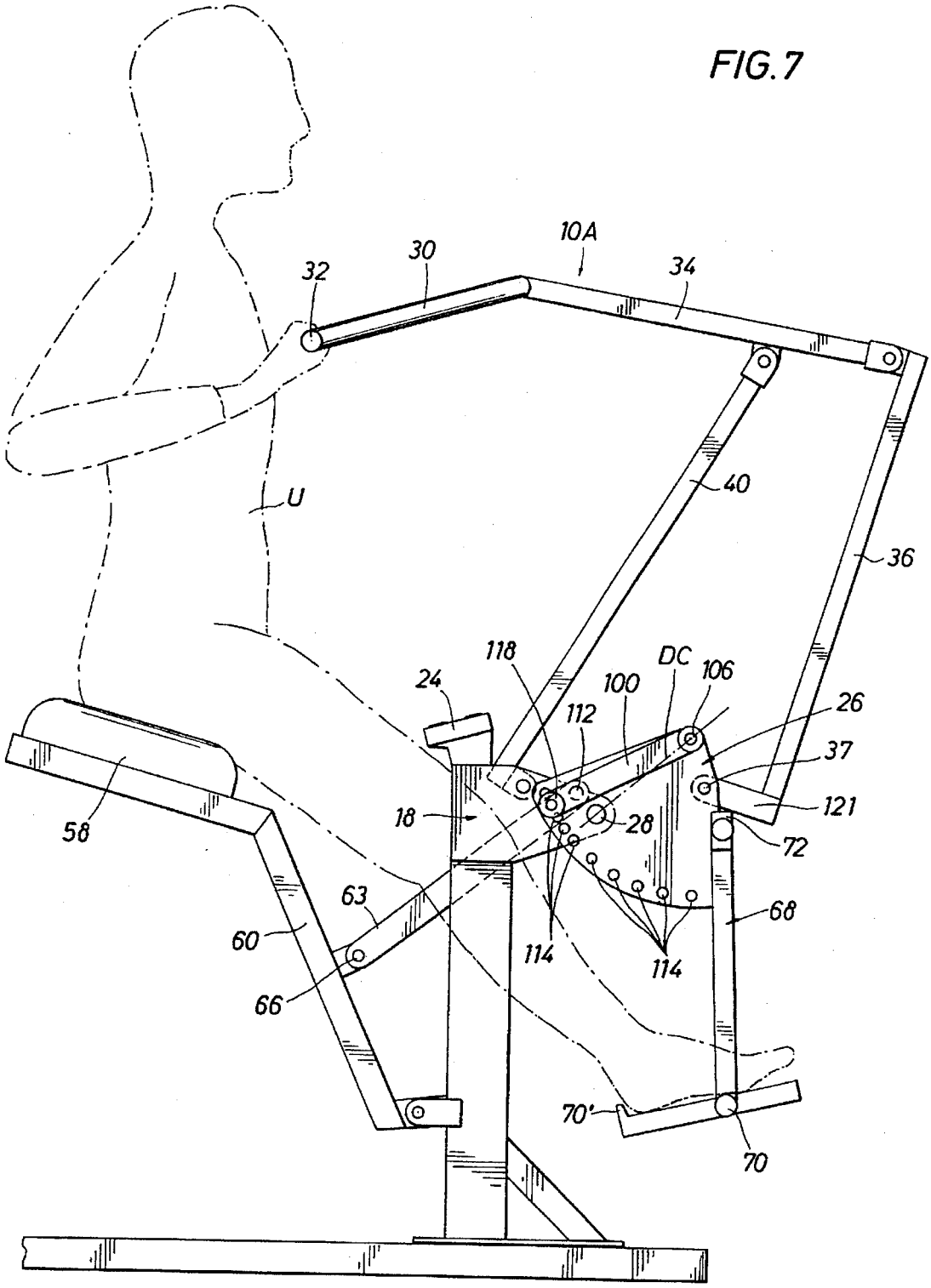
FIG. 7 is a side elevation of an exercise device similar to the exercise device of FIGS. 1–6 but shows a manually adjustable lever for adjusting the resistance applied against the adjustment plate member to an uppermost position past a dead center position of the adjustment lever for effecting pivoting of the adjustment plate member in a reverse direction, the exercise device shown in position for commencement of an exercise movement in which the user pushes the handlebar outwardly and pulls inwardly on the foot pedals, the device of FIG. 7 having no cam arrangement, so that exercises are not restricted exclusive to generally horizontal or vertical movements.
Figure 8:
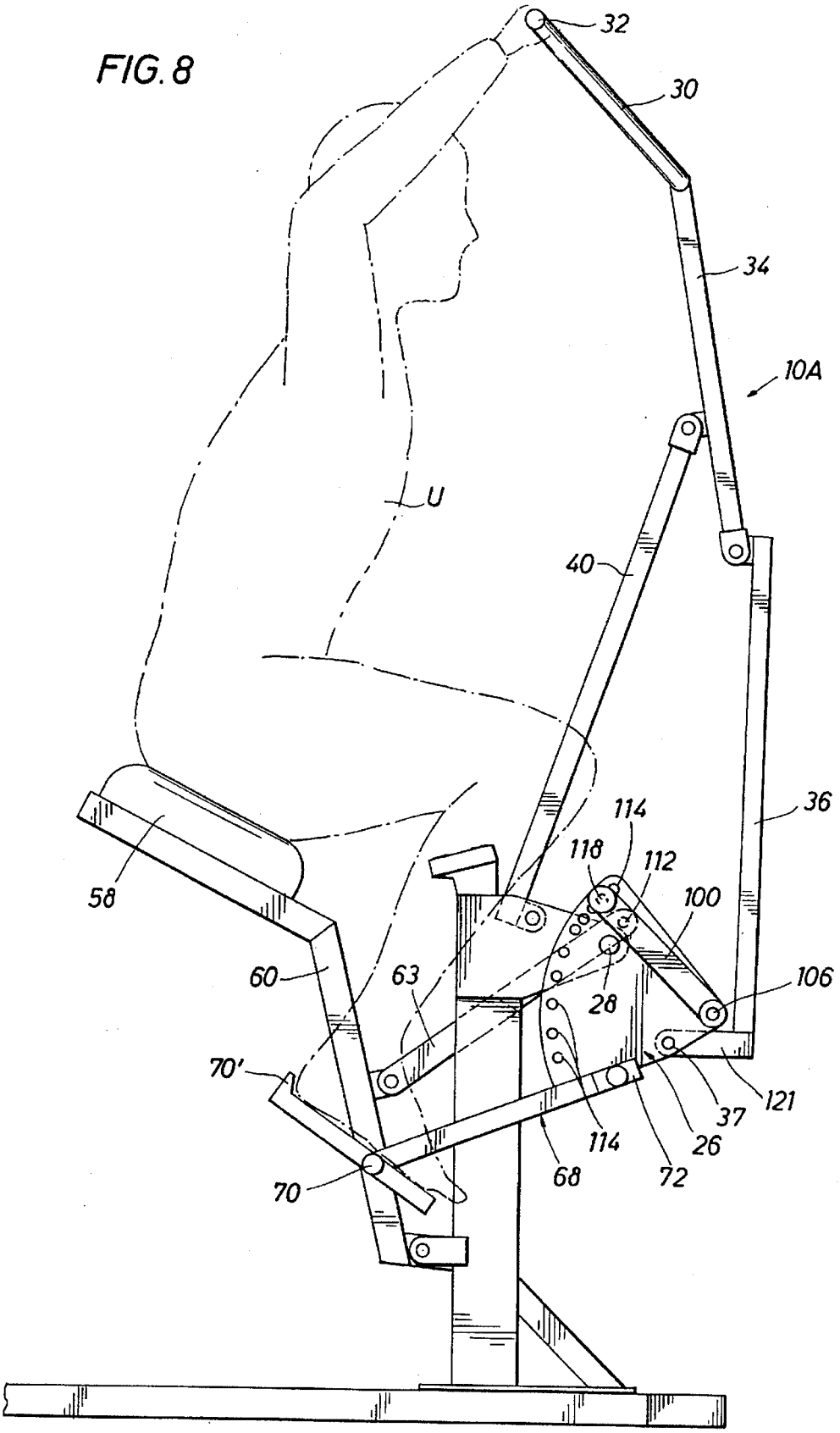
FIG. 8 is a view similar to FIG. 7 but shows the position of the exercise device at the outward portion of the exercise movement illustrated in FIG. 7.

In some instances, it might be desirable to have a free movement of handlebar 32 so that a user U may pull handlebar 30 in any desired direction such as a 45 degree angle to the horizontal. If this is desired, follower 56 may be removed from cam slot 50 of cam plate 48 thereby de-coupling the adjustment plate from link 40. FIGS. 7 and 8 illustrate the removal of cam plate 48 from the preferred embodiment of the invention of FIGS. 1–6.

Variation of Resistance Force

The resistant force may be varied by adjustment of force adjustment lever 100. As shown in FIGS. 1 and 2, adjustment lever 100 is positioned at the lowermost opening 114 in adjustment plate member 26 for the application of a maximum return torque to member 26 from the weight of user U. To reduce such resistance, adjustment lever 100 may be moved upwardly to another selected opening 114 by outwardly pulling of knob 118 for retraction of pin 116 and movement of lever 100 to the desired opening 114. Inner levers 110 along with pivot 112 are moved simultaneously with outer lever 100 because lever 100 is fixed to shaft 106 which in turn is fixed to sleeve 118 for simultaneous movement with adjusting lever 100. The closer that lever 100, (and consequently levers 110 (FIG. 6)) are aligned with pivot 28, the less return torque resistance is applied to the motion of handlebars 30.

Operation of Exercise Device for Pushing Handlebar

FIGS. 7 and 8 illustrate an exercise movement in which the user U pushes outwardly on handlebar 30 and pulls inwardly against heel supports 70' of foot pedals 70 against the resistance provided by the weight of user U on seat 58. The exercise apparatus 10A shown in FIGS. 7 and 8 is similar in certain respects to that shown in FIGS. 1–6 except for the removal of the cam plate 48 and follower 56 shown in FIGS. 1–6 for guiding of handlebar 30 to move exclusively in horizontal or vertical directions during the exercise movement. The pushing exercise movement is accomplished by moving of adjustment lever 100 along with pivot 112 to a position past a dead center position or axis as shown by the broken line DC on FIGS. 7 and 8 extending between pivots 28 and 106 for adjustment plate member 26. By movement of adjustment lever 100 and pivot 112 past the dead center position along axis labeled DC, the force exerted by the weight of user U tends to rotate adjustment plate member 26 in a counterclockwise direction about pivot 28 as shown in FIG. 7. An outward pushing action by user U against handlebar 30 and an inward pulling action against heel supports 70' of foot rests or pedals 70, depending on the angle of force applied against handgrips 32, can move the linkages 34, 40 and 36 to an extreme horizontal position (not shown). Release of the pushing force against handgrips 32 causes the machine to return to the position of FIG. 7. Alternatively, the user may push upwardly against handgrips, thereby bringing the machine to the configuration of FIG. 8. At the end of the exercise movement shown in FIG. 8 and the relaxing of any force exerted by user U, the weight of user U returns exercise device 10A to the position of FIG. 7. The exercise device of FIGS. 1–6 can of course also be used for pushing exercises by changing the position of adjustment lever 100.

From the above description of preferred embodiments of the invention, it is apparent that an exercise device has been provided on which a user may perform various exercise movements with resistance provided by the weight of a user in a seated position. The user may easily change the movement of a handlebar gripped by the user from a generally horizontal exercise movement to a generally vertical exercise movement by changing the motion exerted by the user against the handlebar. The user may, if desired, exercise only the upper limbs by utilizing only the handlebar, or exercise only the lower limbs by utilizing only the foot pedals. If the cam plate is removed from the exercise device, the handlebar is free to move at any angle, either in a pulling motion or in a pushing motion between the vertical and the horizontal directions. Such movements are controlled only by the direction of force exerted by the user against the handlebar.

While preferred embodiments of the present invention have been illustrated in detail, it is apparent that modifications and adaptation of preferred embodiments will occur to those skilled in the art. For example, while the invention is illustrated in the preferred embodiment of a rider-type exercise machine, it may be embodied in a machine in which a user does not "ride" the machine. Examples of such machines are stair climbers, treadmills and bicycle exercise machines. Resistance other than the user's body weight can be provided according to numerous methods known to the art of exercise machines. Accordingly, the scope of the present invention is to be limited only to the extent of the following claims:

What is claimed is:

1. An exercise device comprising:

a frame, a member carried by said frame, a handle bar, linkage means carrying said handlebar and pivotally connected to said frame and to said member for allowing generally vertical exercise movement of said handlebar or a generally horizontal exercise movement of said handlebar, either exercise movement capable of being performed at the discretion of the user by changing the motion exerted through the upper limbs of the user against said handlebar, and resisting means coupled to said member for resisting pulling exercise movements of said handlebar.

2. The exercise device of claim 1 wherein said resisting means includes seat means disposed rearwardly of said frame for supporting the weight of a user, a seat frame extending forwardly of said seat means and pivotally coupled to said frame, and a seat connecting link pivotally connected between said member and said seat frame.

3. The exercise device of claim 2 wherein said member is pivotally connected to said frame at a first pivot point, and said resisting means further includes, an adjustment lever pivotally carried at one end at a second position of said member and coupled at its other end to said seat connecting link at a connecting point, and means for varying the position of said connecting point of said seat connecting link and said adjustment lever with respect to said first pivot point.

4. The device of claim 2 further comprising a cam carried by said linkage means, said cam having a groove, and a cam follower carried by said adjustment member and disposed within said groove, said groove having a first slot means arranged and designed such that as said cam follower moves in said first slot means, said handlebar is constrained to move in a generally vertical direction, said groove having a second slot means arranged and designed such that as said cam follower moves in said second slot means, said handlebar is constrained to move in a generally horizontal direction, said first and second slot means being interconnected so that said cam follower may move between said first slot means and said second slot means by action of the upper limbs of the user on said handlebar.

5. The device of claim 1 further comprising foot pedal means connected to said member for cooperatively aiding said vertical exercise movement or said horizontal exercise movement.

6. The device of claim 1 wherein said resisting means includes adjustment means for selectively adjusting resistance to pushing of said handlebar by said user or to pulling of said handlebar by said user.

7. An exercise device comprising:

a frame;

seat means pivotally connected to said frame for seating a user;

a member pivotally connected at a pivot point to said fixed frame for movement about a generally horizontal axis;

a handlebar for gripping by the seated user, a linkage means carrying said handlebar and pivotally connected to said frame and to said member for allowing a reciprocating exercise movement in a vertical direction of said handlebar by a seated user, a reciprocating exercise movement in a horizontal direction of said handlebar by the seated user, or a reciprocating exercise along any arbitrary angle between said vertical direction and said horizontal direction, such exercise movements capable of being performed selectively at the discretion of the seated user by changing the direction of force exerted by the user against said handlebar; and resisting means adjustably coupled to said member for alternatively resisting pulling or pushing exercise movements of said handlebar.

8. The exercise device of claim 7 wherein:

said resisting means includes a seat connecting link pivotally coupled between said seat means and said member for exerting a force proportional to the weight of the user on said seat against said member which tends to oppose force exerted by said user through said handlebar and said linkage means to said member.

9. The exercise device of claim 8 wherein, said resisting means further includes selectively adjustable coupling means for coupling said seat connecting link to said member at different positions.

10. The exercise device of claim 9 wherein said adjustable coupling means includes:

an adjustable lever pivotally connected to said seat connecting link adjacent said member; and manually adjustable means carried by said adjustment lever for permitting selective positional connection of said seat connecting link to said member so as to vary selectively force resisting pulling or pushing exercise movements of said handlebar.

11. The exercise device of claim 7 further comprising:

foot pedals for engagement by the lower limbs of the user; and foot frame members connected between said foot pedals and said member, the connection of said foot frame members to said member being at a location spaced from said pivot point of said member to said fixed frame.

12. The exercise device of claim 7 wherein:

a first link is secured to and extends from said handlebar;

a generally upright support member is pivotally connected adjacent its upper end to said first link intermediate the length of said first link and pivotally connected adjacent its lower end to said fixed frame; and a second connecting link is pivotally connected adjacent one end to said first link and pivotally connected adjacent an opposite end to said member.

13. An exercise device comprising:

a fixed frame;

an adjustment plate member pivotally connected at a pivot point to said fixed frame for pivotal movement about a horizontal axis;

a handlebar for manual gripping by a user;

linkage means connected to said handlebar and to said adjustment plate member to permit selectively a generally horizontal back and forth exercise movement of said handlebar or a separate generally vertical up and down exercise movement of said handlebar, said exercise movements being caused through user exerted force against said handlebar; and resisting means coupled to said adjustment plate member for resisting the exercise movements of said handlebar, said biasing means including force selection means operatively connected to said adjustment plate member to selectively vary the force which resists exercise movements of said handlebar.

14. The exercise device of claim 13 further comprising:

foot pedals for engagement by the lower limbs of the user; and a foot frame for said foot pedals which is secured to said adjustment plate member for pivotal movement therewith.

15. The exercise device of claim 14 wherein:

a seat is pivotally connected 16 said frame for supporting the user; and said resisting means is coupled between said seat and said adjustment plate member to provide resistance to said exercise movements.

16. The exercise device of in claim 13 wherein said linkage means includes:

a first link secured at one end to said handlebar;

a second link pivotally connected at one end to an opposite end of said first link and pivotally connected at its opposite end to said adjustment plate member; and an intermediate handlebar support member pivotally connected adjacent its upper end to said first link intermediate the length of said first link and pivotally connected adjacent its lower end to said fixed frame.

17. The exercise device of claim 16 further comprising:

cam means for coupling said adjustment plate member to said intermediate handlebar support member so as to cause a predetermined controlled movement of said handlebar in response to pivotal movement of said adjustment plate member.

18. The exercise device of claim 17 wherein:

said cam means for coupling said adjustment plate member to said intermediate support member includes a cam plate secured to said intermediate support member, said cam plate having a cam slot therein; and a follower carried by said adjustment plate member and received within said cam slot to transform pivotal movement of said adjustment plate member into said predetermined controlled movement of said handlebar.

19. The exercise device of claim 18 wherein:

said cam slot includes into two slot portions, one portion receiving said follower for said generally vertical exercise movement, and the other seat portion receiving said follower for said generally horizontal exercise movement.

20. The exercise device of claim 13 wherein:

said force selection means includes manually operated indexing means to selectively vary the force which resists exercise movements of said handlebar.

21. The exercise device of claim 20 wherein:

said resisting means includes a force transmitting link having an end pivotally connected to said force selection means; and said force selection means includes a manually operated indexing lever selectively pivotally connected to said adjustment plate member for selective relative placement of a pivoting point of said force transmitting link with respect to said adjustment plate member for selectively varying the tendency of said adjustment plate to be rotated by a force from said transmitting link.

22. The exercise device of claim 21 wherein:

said force transmitting link has a force transmitting pivot which is movable with said lever, said pivot having a dead center position when positioned along an axis between a pivot point of said lever on said adjustment plate member and the pivot point of said adjustment plate on said fixed frame;

said force transmitting link causing rotation of said adjustment plate member in one direction when said force transmitting pivot is on one side of said axis and causing rotation of said adjustment plate member in an opposite direction when said force transmitting pivot is on the other side of said axis.

23. An exercise device comprising:

a support frame;

an adjustment plate member pivotally connected at a pivot point to said support frame for relative pivotal movement;

a handlebar for manual gripping, a seat for supporting the weight of a user, a seat frame member secured to said seat mad pivotally coupled to said support frame;

a force transmitting link pivotally connected to said seat frame member and coupled to said adjustment plate member for transmitting a force proportional to the weight of the user to said adjustment plate member;

a manually actuated adjustment lever pivotally mounted on said adjustment member and pivotally coupled to said force transmitting link about a force transmitting pivot;

said manually actuated adjustment lever being movable manually to a predetermined releasable position to change the position of said force transmitting pivot for varying the force exerted by the weight of the user against said adjustment plate member; and linkage means pivotally connecting said handlebar to said adjustment member for transferring a component of force exerted by said user to said handlebar to said adjustment member.

24. The exercise device of claim 23 wherein:

said adjustment plate member includes an adjustment plate portion having a series of selected positions for releasably securing said adjustment lever upon manual movement of said adjustment lever and said force connecting link coupled thereto to a desired position.

25. The exercise device of claim 24 wherein:

said force transmitting pivot between said adjustment lever and said force transmitting link has a dead center position when aligned along an axis between a pivot point of said adjustment lever on said adjustment plate member and said pivot point of said adjustment plate member to said fixed frame;

said series of positions on said adjustment plate portion includes a first set of positions and a second set of positions which are located on opposite sides of said axis; and said force transmitting link transmits force applied to said adjustment plate member causing it to rotate in one direction when said force transmitting pivot is placed on one side of said axis and causing said adjustment plate member to rotate in an opposite direction when said force transmitting pivot is positioned on the other side of said axis.

26. The exercise device of claim 25 further comprising:

foot pedals secured to said adjustment plate member at distance from said pivot point for rotation of said adjustment plate member in response to a force of the user against said foot pedals.

27. The exercise device of claim 23 wherein:

said linkage means connected to said handlebar and said adjustment member permits user alternative selection of a generally horizontal back and forth exercise movement of said handlebar or a generally vertical up and down exercise movement of said handlebar, said alternative exercise movements being selectable solely through force exerted against said handlebar by said user.

28. The exercise device of claim 27 wherein:

a first link is connected at one end to said handlebar;

a second link is pivotally connected at one end to an opposite end of said first link and pivotally connected at an opposite end to said adjustment plate member; and an intermediate support member is pivotally connected adjacent its upper end to said first link intermediate the length of said first link and pivotally connected adjacent its lower end to said fixed frame.

29. The exercise device of claim 28 including:

cam means for coupling said adjustment plate member to said intermediate support member for a predetermined controlled movement of said handlebar in response to pivotal movement of said adjustment plate member.

30. The exercise device of claim 29 wherein:

said cam means couples said adjustment plate member to said intermediate support member and includes a cam plate secured to said intermediate support member, said cam plate having a cam slot therein; and a follower carried by said adjustment plate member and received within said cam slot to transform pivotal movement of said adjustment plate member into said predetermined controlled movement of said handlebar.

31. An exercise device as set forth in claim 30 wherein:

said cam slot includes into two slot portions, one slot portion receiving said follower for said generally vertical exercise movement and the other slot portion receiving said follower for said generally horizontal exercise movement.

32. An exercise device comprising a frame, a handlebar, a linkage coupling said handlebar to said frame, so that said handlebar may move with respect to said frame, and a mechanism coupled to said linkage which allows said handlebar to move in a predetermined path including a generally vertical movement of said handlebar or a generally horizontal exercise movement of said handlebar, either exercise movement capable of being performed at the discretion of the user by changing the motion exerted through the upper limbs of the user against said handlebar.

33. The exercise device of claim 32 wherein said mechanism includes a cam mechanism.

34. The exercise machine of claim 33 wherein said cam mechanism includes an arrangement such that said predetermined path is in a horizontal direction.

35. The exercise machine of claim 33 wherein said cam mechanism includes an arrangement such that said predetermined path is in a vertical direction.

36. The exercise machine of claim 32 wherein said path is substantially linear.

37. An exercise device comprising a frame a handlebar, linkage means carrying said handlebar and pivotally connected to said frame member for allowing generally vertical exercise movement of said handlebar or a generally horizontal exercise movement of said handlebar, either exercise movement capable of being performed at the discretion of the user by changing the motion exerted through the upper limbs of the user against said handlebar, and biasing means coupled to said linkage for providing resistance to movements of said handlebar and for allowing selective conversion of said device between a first configuration for resisting pulling of said handlebar and a second configuration for resisting pushing against said handlebar.

38. The exercise device of claim 37 further comprising means for adjusting said biasing means by which the amount of resistance against pulling of said handlebar or alternatively the amount of resistance pushing against said handlebar may be selectively varied by a user.

39. An exercise device comprising:

a frame having a front end and a rear end and designed to rest upon a floor surface;

a force receiving member movably mounted on said frame;

a seat movably mounted on said frame; and a linking means for linking said frame, said force receiving member, and said seat in such a manner that said force receiving member is free to move relative to said frame through a generally vertical exercise movement and a generally horizontal exercise movement, either exercise movement capable of being performed at the discretion of the user by changing the motion exerted through the upper limbs of the user against said force receiving member and said seat moves relative to said frame in response to movement of said force receiving member relative to said frame.

40. The exercise device of claim 39 further comprising adjusting means for adjusting a fraction of a person's bodyweight that is transmitted through said seat to resist upward movement thereof relative to said frame.

41. The exercise device of claim 39 wherein downward movement of said force receiving member causes upward movement of said seat.

42. The exercise device of claim 39 wherein forward movement of said foot support causes upward movement of said seat.

43. The exercise device of claim 39 further comprising a foot support movably mounted on said frame, wherein said foot support moves relative to said frame in response to movement of said force receiving member relative to said frame.

44. The exercise device of claim 43 wherein said seat moves relative to said frame in response to movement of said foot support relative to said frame.

45. The exercise device of claim 44 wherein forward movement of said foot support causes upward movement of said seat.

46. The exercise device of claim 39 wherein said linking means includes:

a first linking member pivotally connected between said force receiving member and said frame;

a second linking member pivotally connected to said frame; and a third linking member pivotally connected between said second linking member and said first linking member.

47. The exercise device of claim 46 further comprising:

a cam on said first linking member; and a cam follower on said second linking member and interengaged with said cam.

48. The exercise device of claim 47 wherein said cam is generally V-shaped.

49. The exercise device of claim 46 further comprising:

a fourth linking member pivotally connected between said seat and said second linking member.

50. The exercise device of claim 49 further comprising a foot support rigidly mounted on said second linking member.

51. The exercise device of claim 46 wherein movement of said force receiving member from a first, relatively forward position to a second, relatively rearward position causes said second linking member to rotate in a first direction, and movement of said force receiving member from said second position to a third, relatively upward position causes said second linking member to rotate in a second, opposite direction.

52. The exercise device of claim 51 wherein movement of said force receiving member from said first position to said second position causes said first linking member to rotate in said first direction, and movement of said force receiving member from said second position to said third position causes said first linking member to rotate further in said first direction.

53. An exercise device comprising:

a frame having a front end and a rear end, and designed to rest upon a floor surface;

a force receiving member movably mounted on said frame;

a linking means for linking said frame and said force receiving member in such a manner that said force receiving member is free to move relative to said frame through at least two discrete paths of motion where said two discrete paths of motion include a generally vertical exercise movement of said force receiving member or a generally horizontal exercise movement of said force receiving member, either of said exercise movements capable of being performed at the discretion of a user by changing the motion exerted through the upper limbs of a user against said force receiving member, and a resistance means for resisting movement of said force resisting member in at least one direction along each of said at least two discrete paths, wherein said resistance means provides resistance as a function of a user's body weight.

54. The exercise device of claim 53 wherein said resistance means includes a seat movably mounted on said frame and coupled to said linking means in such a manner that said seat moves relative to said frame in response to movement of said force receiving member relative to said frame.

55. The exercise device of claim 54 wherein rearward movement of said force receiving member causes upward movement of said seat.

56. The exercise device of claim 55, wherein downward movement of said force receiving member causes upward movement of said seat.

57. The exercise device of claim 54 further comprising a leg support movably mounted on said linking means in such a manner that said leg support moves relative to said frame in response to movement of said seat relative to said frame.

58. An exercise device comprising:

a frame having a front end and a rear end, and designed to rest upon a floor surface;

a force receiving member movably mounted on said frame; and a leg support movably mounted on said frame; and a linkage means for linking said frame, said member, and said leg support in such a manner that said member is free to move relative to said frame through at least two discrete paths of motion where said two discrete paths of motion include a generally vertical exercise movement of said force receiving member or a generally horizontal exercise movement of said force securing member, either of said exercise movements capable of being performed at the discretion of a user by changing the motion exerted through upper limbs against said force receiving member and said leg support moves relative to said frame in response to movement of said member relative to said frame.

59. The exercise device of claim 58 further comprising a resistance means for resisting movement of said force receiving member in at least one direction along each of said at least two discrete paths, wherein said resistance means provides resistance as a function of a user's body weight.

60. The exercise device of claim 59 wherein said resistance means includes a seat movably mounted on said frame, and said seat moves upward in response to forward movement of said leg support.

61. An exercise device comprising:

a frame having a front end and a rear end, and designed to rest upon a floor surface;

a force receiving member movably mounted on said frame;

a linking means for linking said frame and said force receiving member in such a manner that said force receiving member is free to move relative to said frame through at least two discrete paths of motion where said two paths of motion include a generally vertical exercise movement of said force receiving member and a generally horizontal exercise movement of said force receiving member, either of said exercise movements capable of being performed at the discretion of a user by changing the motion exerted through the upper limbs of the user against said force receiving member; and a sensing means for sensing movement of said force receiving member along either of said at least two discrete paths, wherein said sensing means includes a first component mounted on said linking means and a second component mounted on said frame.

62. The exercise device of claim 61 further comprising a seat movably mounted on said frame in such a manner that said seat moves relative to said frame in response to movement of said force receiving member relative to said frame.

63. The exercise device of claim 62 further comprising a leg support movably mounted on said frame in such a manner that said leg support moves relative to said frame in response to movement of said force receiving member relative to said frame.

64. The exercise device of claim 63 wherein rearward movement of said force receiving member causes upward movement of said seat and forward movement of said leg support.

65. The exercise device of claim 64, wherein downward movement of said force receiving member causes upward movement of said seat and forward movement of said leg support.

66. The exercise device of claim 61 wherein said first component includes a magnet, and said second component includes a Hall effect sensor connected to said displaying means by a cable extending therebetween, and a signal is transmitted to said displaying means each time said magnet passes said sensor.

* * * * *